US009527720B2

(12) United States Patent
Clever et al.

(10) Patent No.: US 9,527,720 B2
(45) Date of Patent: Dec. 27, 2016

(54) NOZZLE FOR DISPENSING PRESSURIZED FLUID

(71) Applicants: Bryan William Clever, Liberty Township, OH (US); Debasish Mahanty, Mumbai (IN); Sandip Balwant Shinde, Mumbai (IN); Nitin Ramnath Sanap, Pin (IN); Keshavkumar Parshuram Behera, Mumbai (IN)

(72) Inventors: Bryan William Clever, Liberty Township, OH (US); Debasish Mahanty, Mumbai (IN); Sandip Balwant Shinde, Mumbai (IN); Nitin Ramnath Sanap, Pin (IN); Keshavkumar Parshuram Behera, Mumbai (IN)

(73) Assignee: OPW FUELING COMPONENTS INC., Hamilton, OH (US)

( * ) Notice: Subject to any disclaimer, the term of this patent is extended or adjusted under 35 U.S.C. 154(b) by 22 days.

(21) Appl. No.: 14/575,624

(22) Filed: Dec. 18, 2014

(65) Prior Publication Data

US 2016/0176700 A1 Jun. 23, 2016

(51) Int. Cl.
*B67D 7/42* (2010.01)

(52) U.S. Cl.
CPC ..... *B67D 7/42* (2013.01)

(58) Field of Classification Search
CPC ..... B67D 7/42; B67D 7/54
USPC ..... 222/478, 544, 481, 566, 3, 205, 509; 137/614.05, 614.06
See application file for complete search history.

(56) References Cited

U.S. PATENT DOCUMENTS

| | | | | |
|---|---|---|---|---|
| 2,004,203 A * | 6/1935 | Howell | B67D 7/42 222/509 |
| 2,030,510 A | 2/1936 | Griffiths | |
| 2,470,368 A * | 5/1949 | Paxton | B67D 7/42 137/509 |
| 2,577,255 A * | 12/1951 | Logan | B67D 7/42 137/382 |
| 2,686,626 A | 8/1954 | Slattery | |
| 2,763,407 A * | 9/1956 | Rowell | B67D 7/42 137/630.14 |
| 3,273,609 A | 9/1966 | Carder et al. | |

(Continued)

FOREIGN PATENT DOCUMENTS

| | | |
|---|---|---|
| DE | 3313258 | 10/1984 |
| DE | 20305357 | 7/2003 |

(Continued)

*Primary Examiner* — Donnell Long
(74) *Attorney, Agent, or Firm* — Thompson Hine LLP

(57) ABSTRACT

A dispensing nozzle including a nozzle body defining a fluid path therein and configured such that fluid is flowable through the fluid path in a downstream direction. The nozzle includes an inlet valve in the fluid path and a vent valve in the fluid path positioned downstream of the inlet valve. The nozzle further includes a slide component positioned between the vent valve and the inlet valve, and an actuator that is manually movable between a first position and a second position. The actuator is operatively coupled to the slide component and configured such that operation of the actuator from the first position to the second position directly or indirectly causes the inlet valve to open and directly or indirectly causes the vent valve to close.

32 Claims, 12 Drawing Sheets

(56) References Cited

U.S. PATENT DOCUMENTS

| | | | | | |
|---|---|---|---|---|---|
| 3,899,009 | A * | 8/1975 | Taylor | B67D 7/54 | 141/59 |
| 3,974,865 | A * | 8/1976 | Fenton | B67D 7/54 | 141/226 |
| 4,056,131 | A * | 11/1977 | Healy | B67D 7/54 | 141/206 |
| 4,057,086 | A * | 11/1977 | Healy | B67D 7/54 | 141/206 |
| 4,397,405 | A * | 8/1983 | Batson | B67D 7/42 | 222/14 |
| 5,060,982 | A | 10/1991 | Matsushita | | |
| 5,095,947 | A | 3/1992 | Weh et al. | | |
| 5,234,036 | A * | 8/1993 | Butkovich | B67D 7/48 | 141/1 |
| 5,301,723 | A | 4/1994 | Goode | | |
| 5,413,309 | A | 5/1995 | Giesler | | |
| 5,575,510 | A | 11/1996 | Weh et al. | | |
| 5,632,432 | A * | 5/1997 | Schulze | A61B 17/07207 | 227/176.1 |
| 5,676,181 | A * | 10/1997 | Healy | B67D 7/54 | 141/206 |
| 5,713,401 | A * | 2/1998 | Weeks | B67D 7/54 | 141/206 |
| 6,035,894 | A * | 3/2000 | Weh | F16L 37/1215 | 137/614.05 |
| 6,099,044 | A | 8/2000 | Weh et al. | | |
| 6,926,310 | B1 * | 8/2005 | Weh | F16L 37/1215 | 137/614.05 |
| 7,588,060 | B2 | 9/2009 | Ballard | | |
| 8,033,305 | B2 | 10/2011 | Weh et al. | | |
| 2007/0151992 | A1 * | 7/2007 | Carlson | B67D 1/0006 | 222/509 |
| 2012/0227862 | A1 * | 9/2012 | Garrison | B67D 7/54 | 141/59 |
| 2014/0263420 | A1 * | 9/2014 | Lambrix | F17C 7/00 | 222/3 |

FOREIGN PATENT DOCUMENTS

| | | |
|---|---|---|
| EP | 0039977 | 8/1981 |
| EP | 0122404 | 10/1984 |
| EP | 1006310 | 6/2000 |
| WO | 93/20378 | 10/1993 |
| WO | 98/04866 | 2/1998 |

* cited by examiner

NOZZLE FOR DISPENSING PRESSURIZED FLUID

The present invention is directed to a nozzle for dispensing pressurized fluid, such as compressed natural gas or the like.

BACKGROUND

Compressed natural gas ("CNG"), which can take the form of methane in its gaseous state under high pressure, or a combination of gases of mostly methane, is often used as a fuel source. In particular, CNG can be used as a fuel for automobile vehicles, railroad locomotives, and has various other uses. CNG is typically stored in pressure vessels/storage tanks, and it may be desired to transfer the CNG from the pressure vessel/storage tank into another storage device, such as a storage device/fuel tank in an automotive vehicle. In order to enable such a transfer, a hose, with a nozzle at one end thereof, can be connected to the storage vessel. The nozzle can then be manually operated to dispense CNG from the storage tank to the automotive vehicle tank.

Such nozzles typically include a number of valves to prevent inadvertent dispersal of the pressurized CNG, as well as to provide certain venting arrangements to avoid an undesirable pressure build-up. However, many existing nozzles do not provide a sufficiently robust valve arrangement wherein the nozzle can be quickly and easily operated in an intuitive manner.

SUMMARY

Accordingly, in one embodiment the present invention is a nozzle for dispensing CNG including a robust valve arrangement in which the nozzle and various valves can be relatively quickly and easily operated in an intuitive manner. More particularly, in one embodiment the invention is a dispensing nozzle including a nozzle body defining a fluid path therein and configured such that fluid is flowable through the fluid path in a downstream direction. The nozzle includes an inlet valve in the fluid path and a vent valve in the fluid path positioned downstream of the inlet valve. The nozzle further includes a slide component positioned between the vent valve and the inlet valve, and an actuator that is manually movable between a first position and a second position. The actuator is operatively coupled to the slide component and configured such that operation of the actuator from the first position to the second position directly or indirectly causes the inlet valve to open and directly or indirectly causes the vent valve to close.

DETAILED DESCRIPTION

Figure 1:
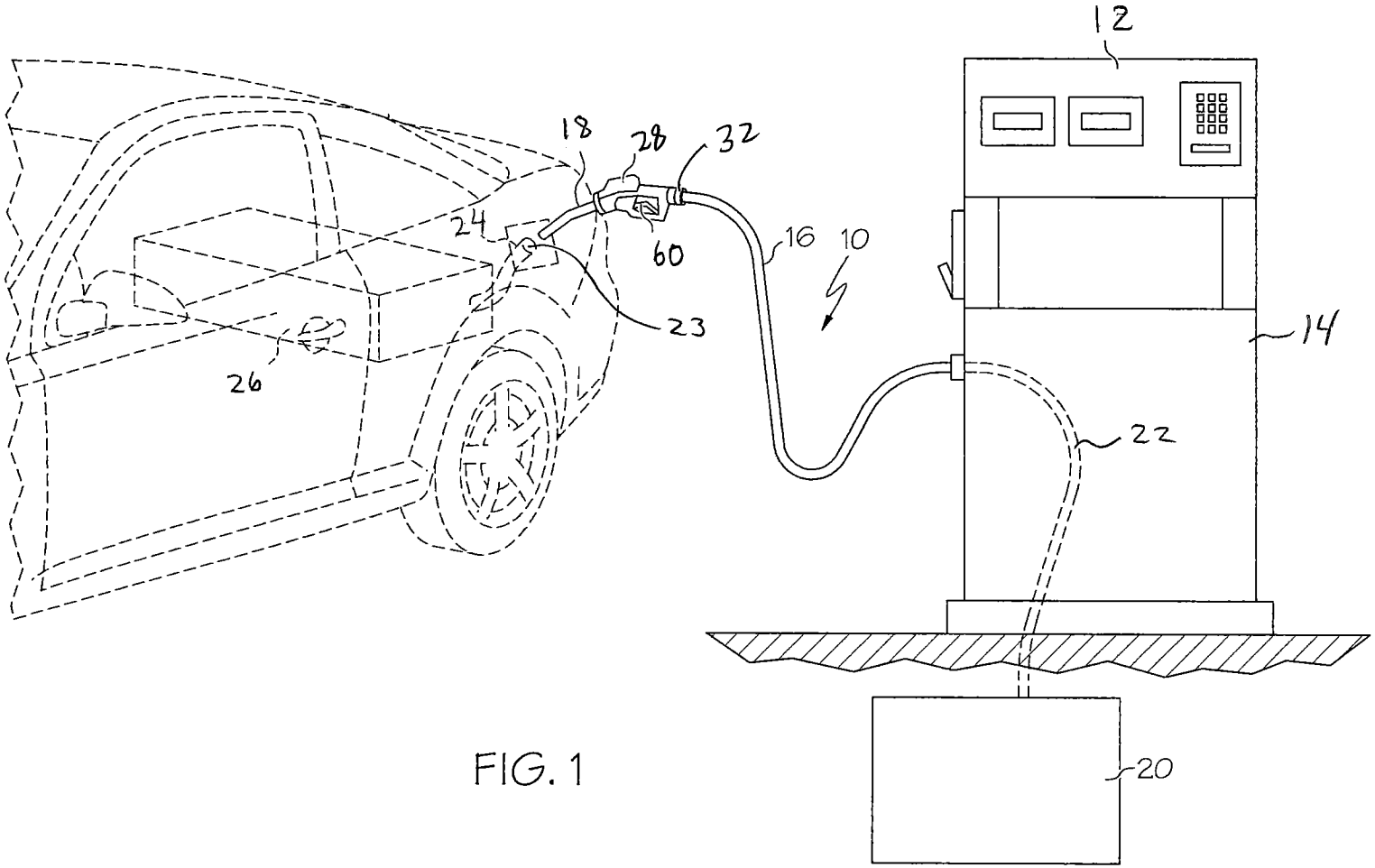
FIG. 1 is a schematic representation of a refilling system utilizing a dispenser.

FIG. 1 is a schematic representation of a refilling system 10 including a dispenser 12. The dispenser 12 includes a dispenser body 14, a hose 16 coupled to the dispenser body 14, and a nozzle 18 positioned at the distal end of the hose 16. The hose 16 may be generally flexible and pliable to allow the hose 16 and nozzle 18 to be positioned in a convenient refilling position as desired by the user/operator. The dispenser 12 is in fluid communication with a fuel/fluid storage tank, pressure vessel or reservoir 20. For example, in the embodiment of FIG. 1 the refilling system 10 includes a fluid conduit 22 extending from the dispenser 12 to the storage tank 22.

During refilling, as shown in FIG. 1, the nozzle 18 is coupled to a coupling 23 positioned in or coupled to a fill pipe 24 of a vehicle storage device/fuel tank 26. The coupling 23 can include a check valve or the like (not shown) therein. The nozzle 18 can then be actuated/operated, as will be described in greater detail below, to enable pressurized CNG to flow from the reservoir 20 through the hose 16, nozzle 18, coupling 23 and fill pipe 24 to the fuel tank 26.

Figure 4:
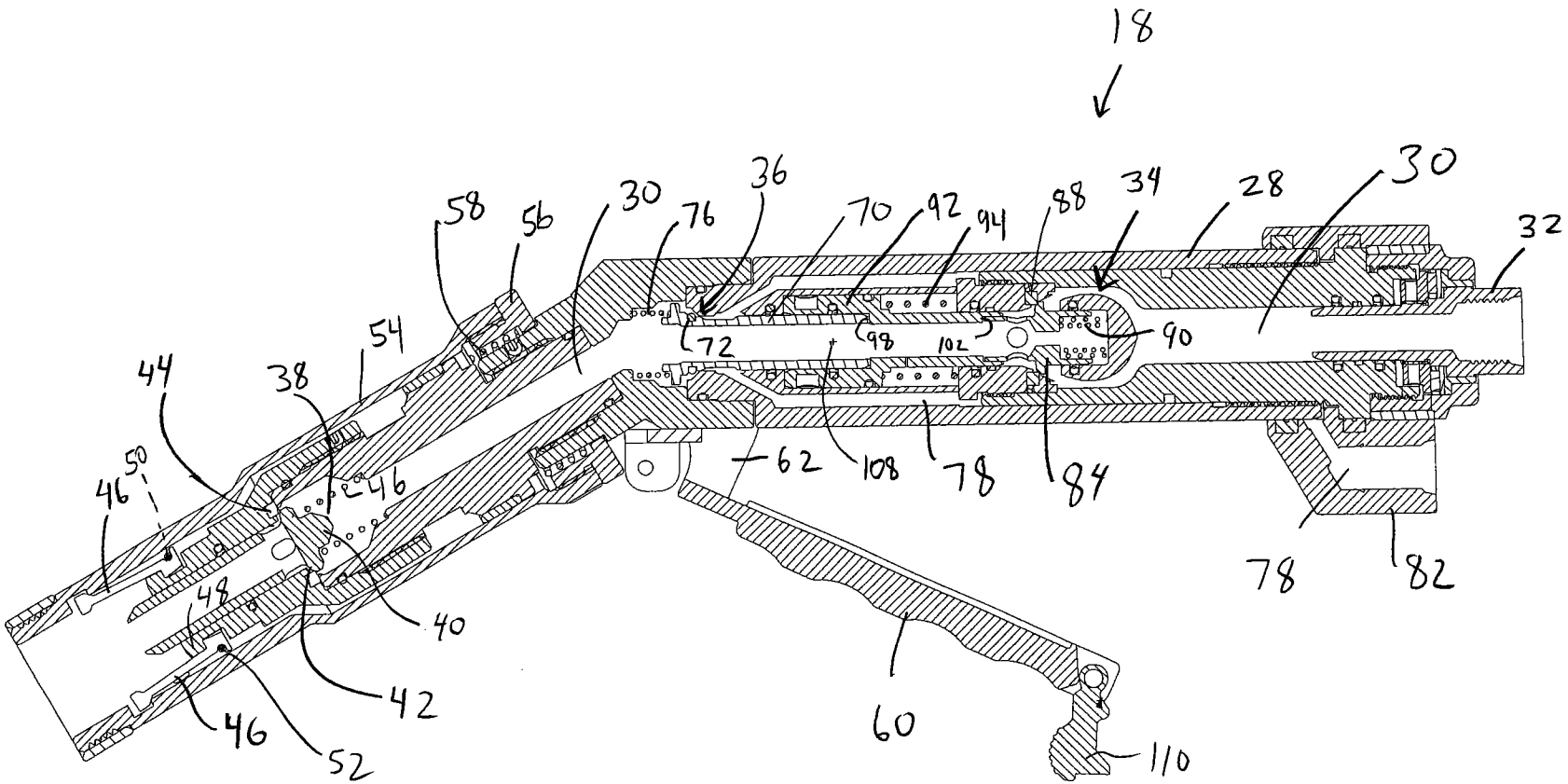
FIG. 4 is a side cross-section of the nozzle of FIG. 3, taken along line 4-4.

With reference to FIG. 4, the nozzle 18 can include a nozzle body 28 defining a fluid path 30 therein configured such that fluid/fuel flows through the fluid path 30 in a downstream direction (from right to left in the illustrated embodiment). An upstream end of the nozzle 18 can include a coupling 32 which is connectable with the hose 16 to introduce fluid to the fluid path 30 at an upstream portion of the nozzle 18.

The nozzle 18 can include a main, or inlet, valve assembly 34 in the fluid path 30, adjacent to the coupling 32, which is biased to its closed/sealed position in the configuration shown in FIG. 4. The nozzle 18 can further include a vent valve 36 in the fluid path 30 and positioned downstream of the inlet valve 34. The vent valve 36 is biased to its open position in the configuration shown in FIG. 4 and provides venting in a manner which will be described in greater detail below. Finally, the nozzle 18 can include an outlet valve 38 in the fluid path 30 and positioned downstream of the inlet valve 34 and the vent valve 36, and biased to its closed position in the configuration shown in FIG. 4.

The outlet valve 38 can take a variety of forms, but in the illustrated embodiment includes an axially movable outlet valve body 40 having a sealing surface 42 configured to sealingly engage an outlet valve seal 44 on the nozzle body 28. The outlet valve body 40 is spring biased, by an outlet valve spring 46, to its downstream/closed position wherein the outlet valve body 40 sealingly engages the outlet valve seal 44.

Figure 6:
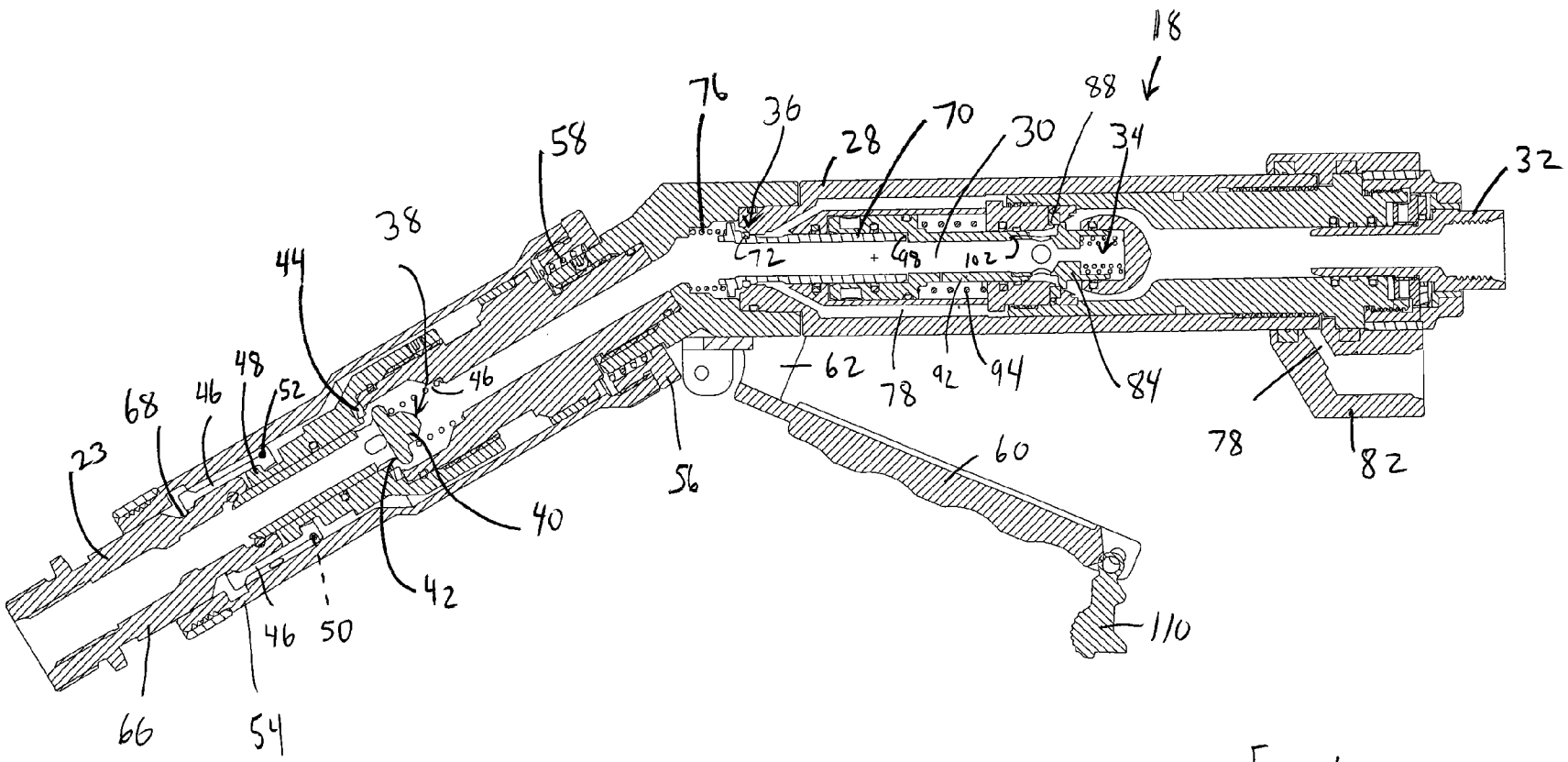
FIG. 6 is a side cross-section of the nozzle of FIG. 2, with a filler valve inserted into an end thereof and the actuator partially raised.

The nozzle 18 can further include a set of jaws 46 at a distal end of the nozzle body, located adjacent to the outlet valve 38. Each of the jaws 46 is pivotally mounted to a pivot frame 48 of the nozzle body 28 such that the jaws 46 are pivotable between a radially outer position, as shown in FIG. 4, and a radially inner position, as shown in FIG. 6. Each of the jaws 46 includes a groove 50 at an upstream end thereof, which receives a spring 52 in tension therein which extends circumferentially about the fluid path 30, to bias the jaws 46 to their radially outer positions.

An axially slidable sleeve 54 is positioned radially outside the jaws 46, and includes a sleeve ring 56 at an upstream end thereof. A sleeve spring 58 engages the underside of the sleeve ring 56 to bias the sleeve to its retracted (upstream) position, shown in FIG. 4.

Figure 7:
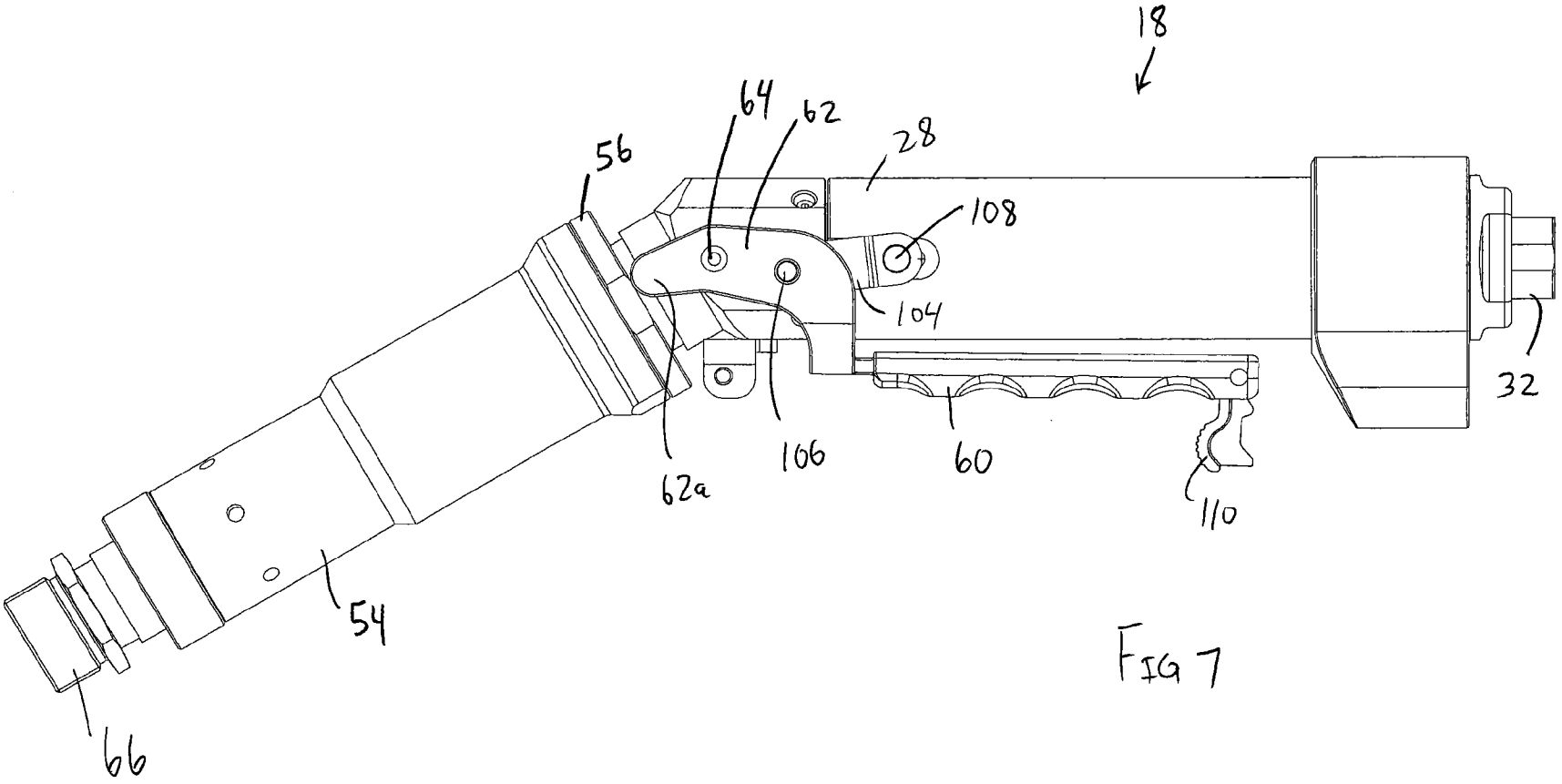
FIG. 7 is a side view of the nozzle of FIG. 2, with the actuator fully raised.
Figure 8:
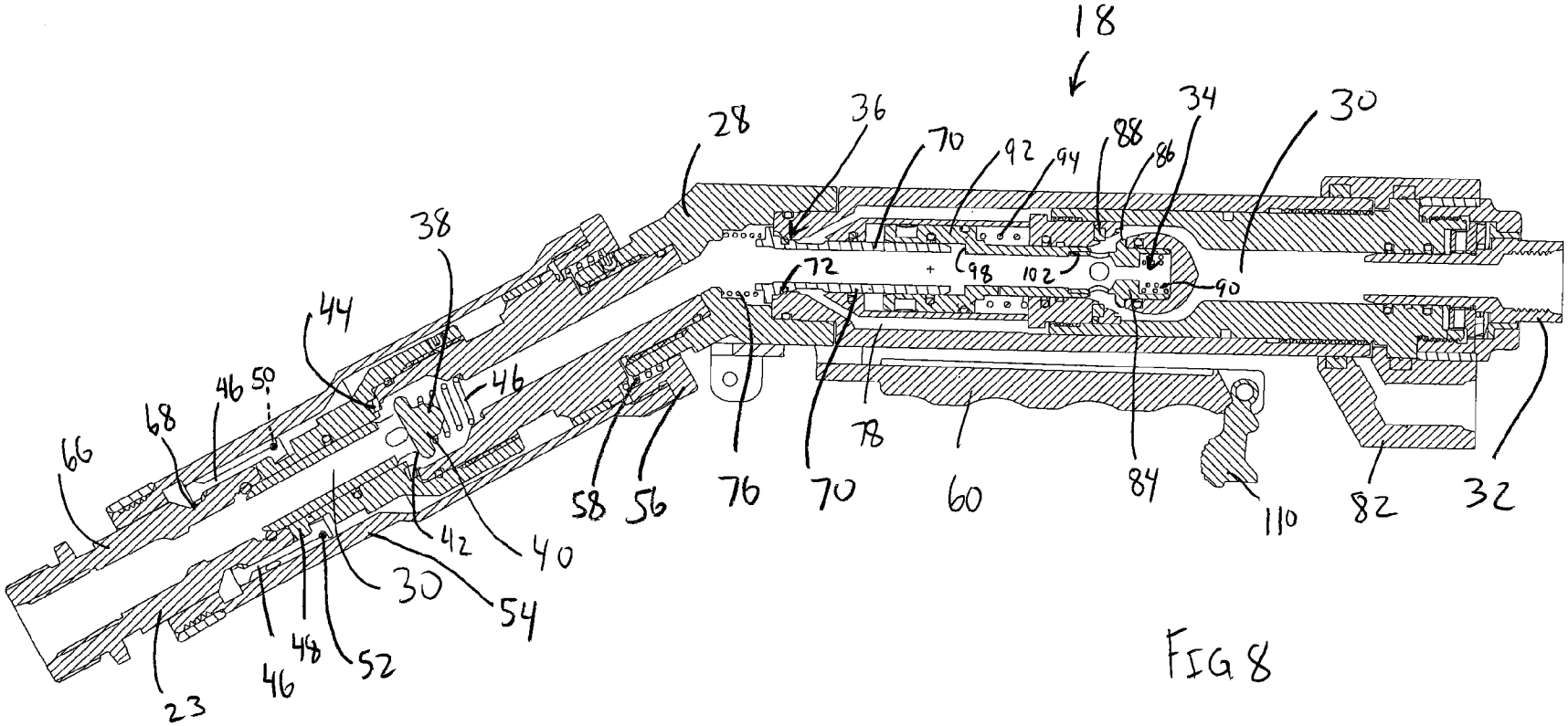
FIG. 8 is a side cross-section of the nozzle of FIG. 7.
Figure 9:
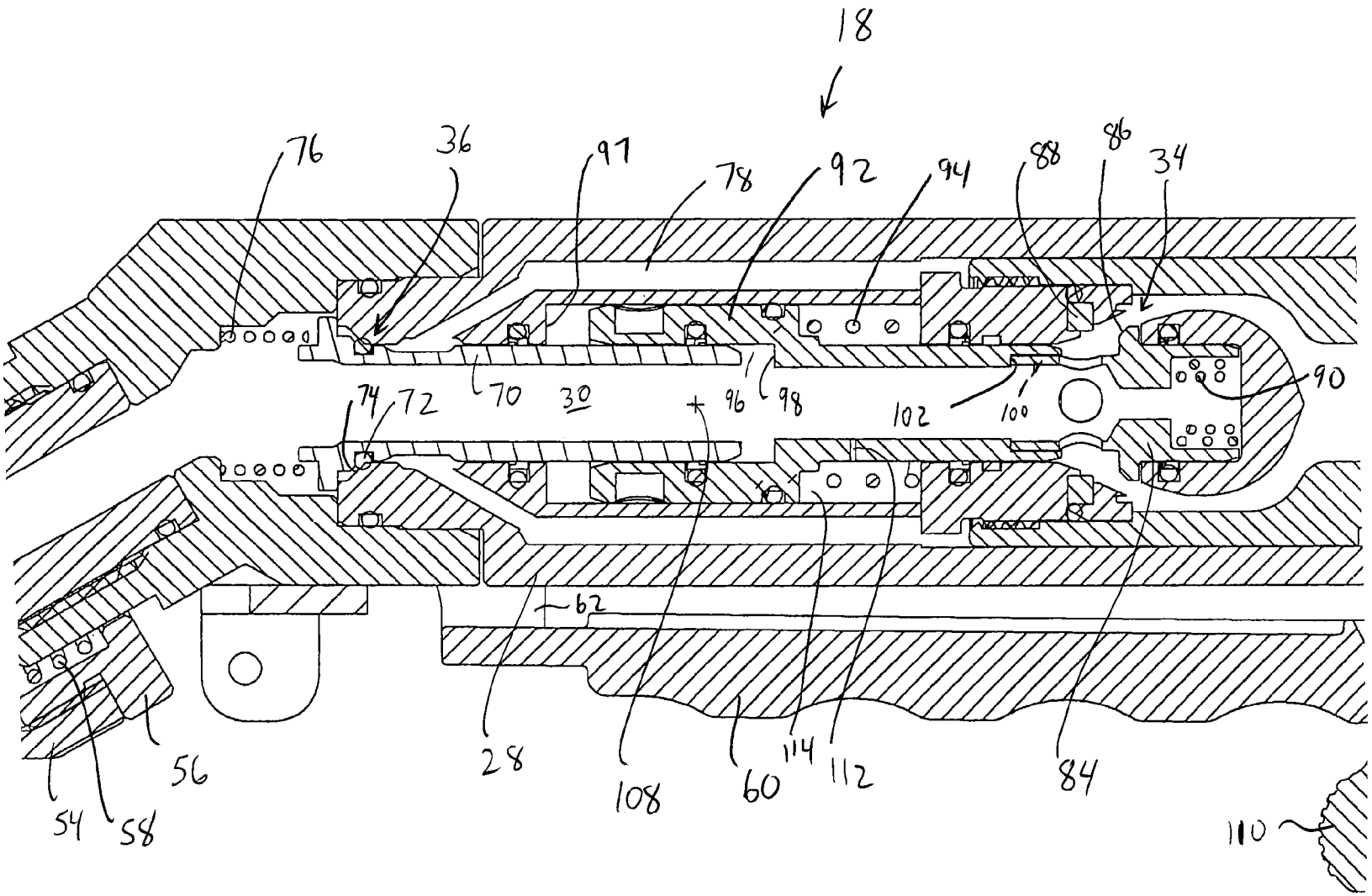
FIG. 9 is a detail view of part of the nozzle of FIG. 8.

The nozzle 18 can include a lever/actuator 60 positioned on and pivotally mounted to the underside of the nozzle body 28 (when the nozzle 18 is in its dispensing position, as shown in FIG. 1 wherein the upstream portion of the nozzle body 28 is oriented generally horizontally) such that the actuator 60 provides a pistol-style nozzle 18. In this case, for example, the nozzle 18 can be gripped, manipulated, and inserted with a single hand, and the actuator 60 operated with the same single hand. The actuator 60 is pivotable, about a generally horizontal axis when the nozzle 18 is in its dispensing position, between a lower (or first or non-dispensing) position (FIGS. 2 and 4) and an upper (or second or dispensing) position (FIGS. 7-9). In the illustrated embodiment, the actuator 60 includes a lever extension 62 (FIG. 2) rigidly coupled to and/or forming a part of the actuator 60. The actuator 60/lever extension 62 is pivotally coupled to the nozzle body 28 (such as by a pin connection) at an actuator connection/pivot point 64.

With reference to FIG. 6, the coupling 23/fill pipe 24/fuel tank 26 can include a protruding filler valve 66 having a circumferential groove formed 68 extending thereabout. In order to commence filling/refueling operations, the nozzle 18 is first placed adjacent to the vehicle fuel tank 26 or other receptacle. The filler valve 66 is then inserted into the distal end of the nozzle 18 such that the filler valve 66 engages the outlet valve body 40, moving the outlet valve body 40 axially upstream, compressing the outlet valve spring 46 and opening the outlet valve 38. This arrangement helps to ensure that pressurized fluids cannot escape the nozzle 18 unless a positive connection is made with the filler valve 66.

Figure 5:
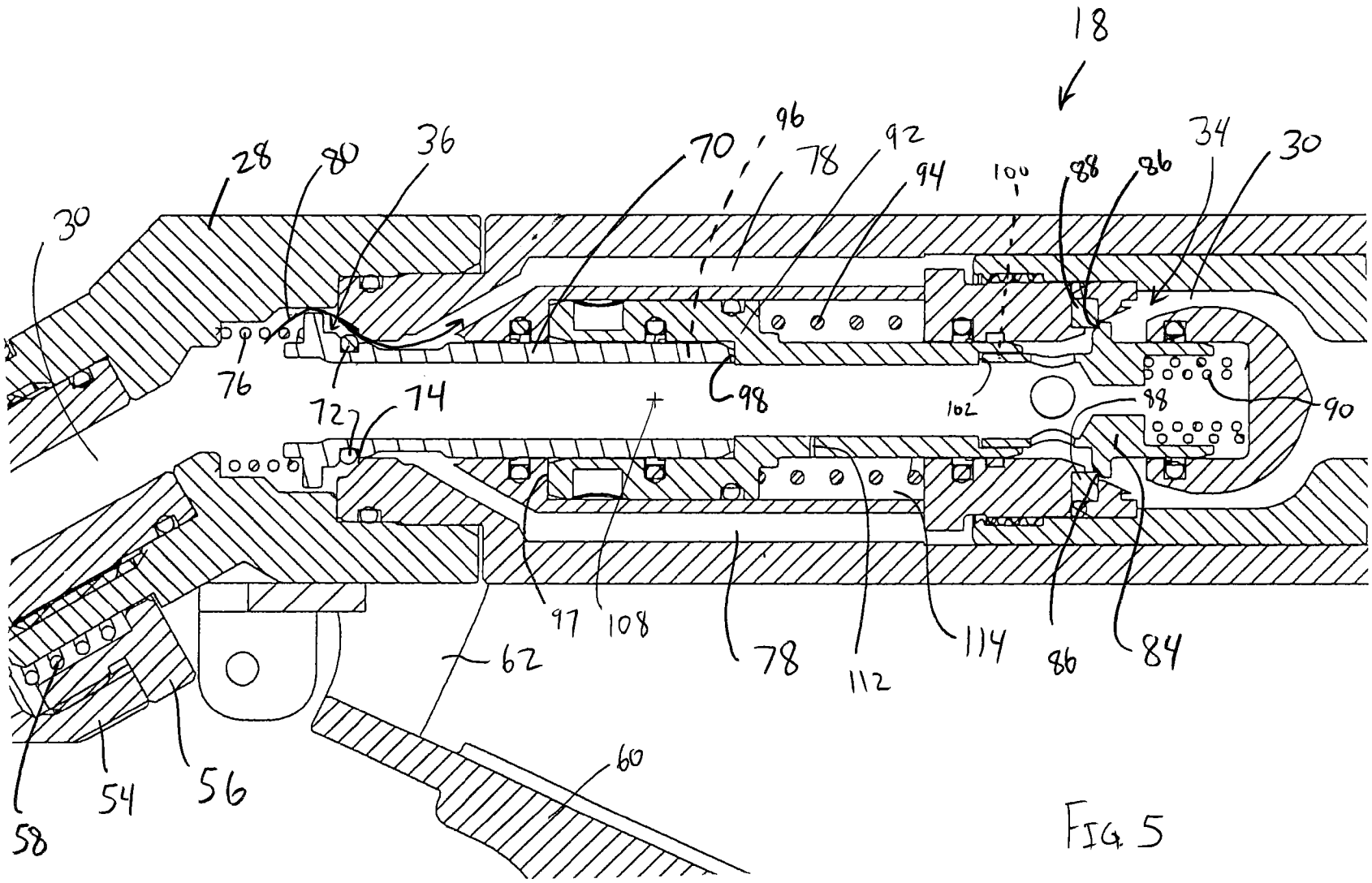
FIG. 5 is a detail view of part of the nozzle of FIG. 4.

Once the filler valve 66 is inserted into the distal end of the nozzle 18, opening the outlet valve 38, the actuator 60 can be gripped and pivoted about the actuator pivot point 64 from its lower position (FIGS. 2 and 4) to its upper position (FIGS. 7 and 8). When the actuator 60 is moved to its upper position, a distal end 62*a* of the lever extension 62 engages, and slides along (downwardly and to the right in the illustrated embodiment of FIG. 2) the sleeve ring 56, thereby urging the sleeve 54 and sleeve ring 56 axially in the downstream direction (as can be seen in comparing the position of the sleeve 54 in FIG. 2 to FIG. 7). As the sleeve 54 slides in the downstream direction, the sleeve 54 engages the outer surfaces of the jaws 46, urging the jaws 46 inwardly such that they are received in the groove 68 of the filler valve 66 (see FIG. 8), thereby interlocking the nozzle 18 and the filler valve 66. This action of raising the actuator 60 thereby locks the filler valve 66 in place in the nozzle 18, and prevents inadvertent separation thereof With reference to FIG. 5, the vent valve 36 includes an axially moveable vent valve body 70 carrying a vent valve seal 72 thereon, which is sealingly engageable with a vent valve seat 74 in the nozzle body 28. FIG. 5 illustrates the vent valve 36 in its open position where the vent valve seal 72 is spaced away from the vent valve seat 74. The vent valve 36 includes a vent valve spring 76, engaging the vent valve body 70 and urging the vent valve body 70 upstream towards its closed/sealed position, but the vent valve body 70 is held in its open position in FIG. 5 by structure which will be described below.

When the vent valve 36 is open, the vent valve 36 allows fluid communication between part of the fluid flow path 30 positioned immediately downstream of the vent valve body 70 and a vent path 78, as shown by arrow 80 of FIG. 5. The vent path 78 is positioned radially outside the fluid flow path 30 and allows fluid communication between the fluid flow path 30 and terminates at a vent outlet 82 (FIG. 4). The vent outlet 82 provides a coupling such that any fluid vented via the vent valve 36 can be vented to the ambient environment, or captured and routed as desired. The vent valve 34 helps to avoid undesired pressure build-up in the nozzle 18. In particular, when the nozzle 18 and coupled to the coupling 23/fill pipe 24, but is not dispensing fluid (e.g. the actuator 60 is in its lower position), pressure in the tank 26 or otherwise in the system can be transmitted to the nozzle 18, which may be desired to be vented to avoid damage to the nozzle 18 and/or an uncontrolled loss of pressure, and/or to enable the nozzle 18 to be decoupled. The vent valve 36 thus allows a controlled venting wherein the vented fluids can be discharged or captured as desired.

As best shown in FIG. 5, the inlet valve 34 includes an axially movable inlet valve body 84 having a sealing surface 86 configured to sealingly engage an inlet valve seat/seal 88 on the nozzle body 28. The inlet valve 34 is spring biased, by an inlet valve spring 90, to its closed/downstream position wherein the inlet valve body 84 sealingly engages the inlet valve seal 88.

The nozzle 18 further includes a slider, or slider/slide component 92, positioned in the fluid path 30 in one case and axially movable therein. In the illustrated embodiment, the slider 92 is positioned between the inlet valve 34 and vent valve 36, although, as will be described in greater detail below, the slider 92 can be arranged in various other positions. A slider spring 94 is positioned in the fluid path 30 and engages the slider 92, biasing the slider 92 to its downstream position (to the left in the illustrated embodiment). The slider 92 includes a downstream recess 96 which can closely receive an upstream end of the vent valve body 70 therein, terminating in a downstream engagement surface/shoulder 98. The slider 92 also includes an upstream recess 100 which can closely receive a downstream end of the inlet valve body 84 therein, terminating in an upstream engagement surface shoulder 102. As will be described in greater detail below, the slider 92 is operatively coupled to the actuator 60 such that movement of the actuator 60 positively causes movement of the slider 92, in at least one direction.

Figure 2:
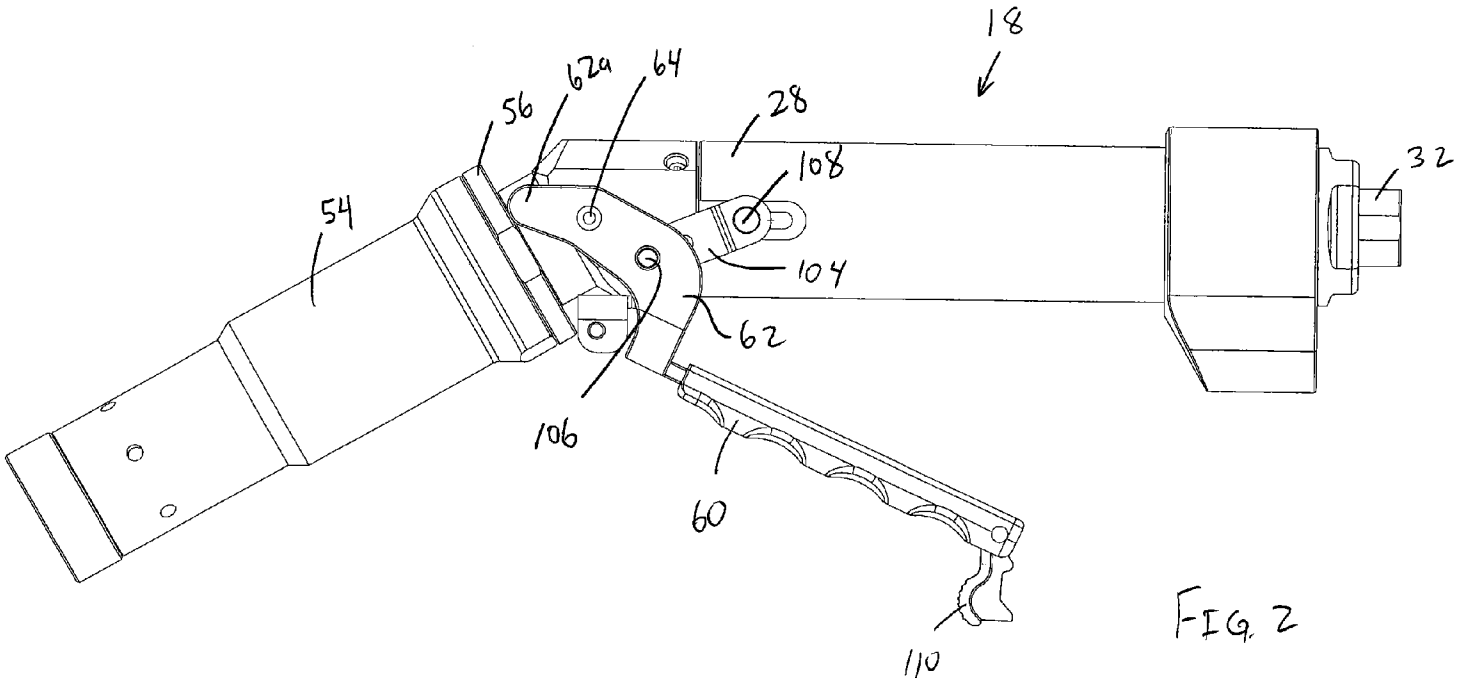
FIG. 2 is a side view of a nozzle of the system of FIG. 1.
Figure 3:
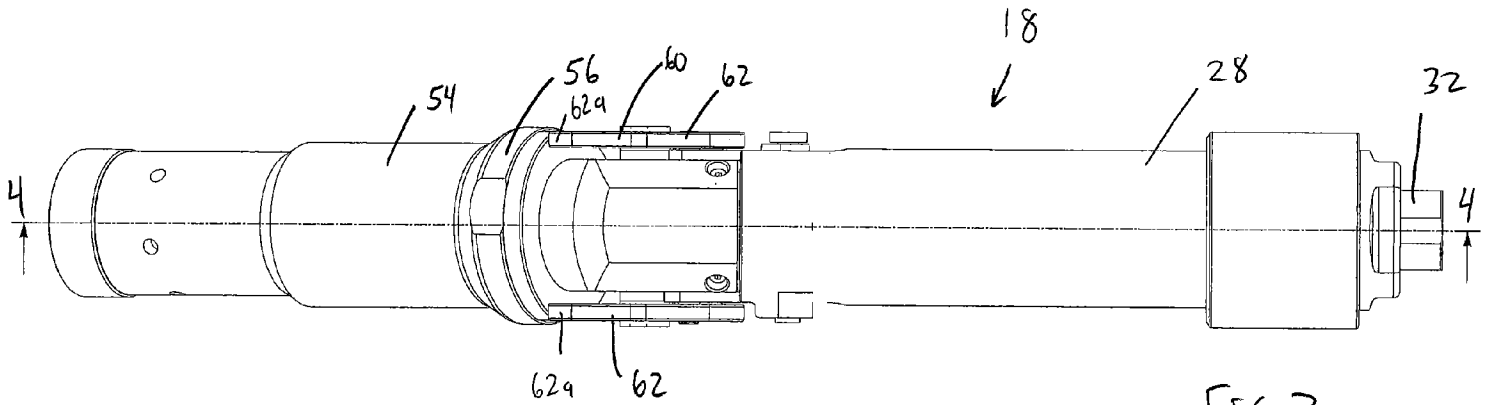
FIG. 3 is a top view of the nozzle of FIG. 2.

As best shown in FIG. 2, the nozzle 18 includes a link 104 that is operatively coupled to the actuator 60 (and more particularly, the lever extension 62 thereof) at one end at a link connection/pivot point 106, which is spaced away from the actuator pivot point 64. The link 104 is operatively/directly coupled to the slider 92 at its other end, such as by a pin connection 108 in one case. In one embodiment, then, the link 104 is directly coupled at both ends by pinned connections, without the use of any rollers or the like. As shown in FIG. 3, the nozzle 18 may in fact include a pair of lever extensions 62 and links 104, one on each side of the nozzle body 28, each of which provides the same function described herein.

As outlined above, the vent valve 36 is spring biased by the vent valve spring 76 to its closed (downstream) position. In the configuration shown in FIG. 5, the slider 92 engages an upstream end of the vent valve body 70 at shoulder 98. The slider 92 is biased by its spring 94 in the upstream direction against surface 97, and has a stronger spring force than the vent valve spring 76. The slider 92 therefore, in the configuration of FIGS. 4 and 5, keeps the vent valve 36 in its open position and prevents the vent valve 36 from closing. In addition, as can be seen in FIG. 5, there is a slight gap between the upstream shoulder 102 of the slider 92 and the inlet valve body 84, such that the upstream shoulder 102 is spaced away, and does not engage, the inlet valve body 84. Thus the inlet valve 34 is fully closed in the configuration of FIG. 4. In this state, then, when the actuator 60 is in its lower position: 1) the inlet valve 34 is closed; 2) the vent valve 36 is opened; 3) the outlet valve 38 is closed; and 4) the filler valve 66 is not locked in place in the nozzle 18.

As already described above, in order to initiate dispensing operations, the filler valve 66 of the fuel tank 26 is inserted into the nozzle 18, opening the outlet valve 38, and the actuator 60 is raised, locking the jaws 46 in place in the circumferential groove 68 on the filler valve 66. Movement of the actuator 60 from its lower position to its upper position also causes the slider 92 to move from its downstream position, shown in FIGS. 4 and 5, to its upstream position shown in FIGS. 8 and 9, due to the pinned connection between the link 104, the slider 92 and the actuator 60. When the actuator 60 is raised and the slider 92 is moved to its upstream position, the downstream shoulder 98 of the slider 92 is moved away from and out of engagement with the vent valve body 70, enabling the vent valve 36 to move to its closed position, as biased by the vent valve spring 76, as shown in FIG. 9. With further reference to FIG. 9, when the actuator 60 is fully raised there is a gap between the vent valve body 70 and the downstream shoulder 98 to enable the vent valve 36 to close completely.

In addition, as the slider 92 moves upstream, the upstream shoulder 102 of the slider 92 contacts the inlet valve body 84 and moves the inlet valve body 84 upstream, thereby opening the inlet valve 34 and compressing the inlet valve spring 90. In one embodiment the slider 92 moves fully away, and out of engagement, with the vent valve body 70 before it engages the inlet valve body 84. If desired, the actuator 60 can be automatically retained in its upper position, such as by engaging a locking mechanism 110 on a distal end of the actuator 60, with a handle guard (not shown), or by various other known mechanisms.

In this state, then, when the actuator 60 is in its upper position: 1) the inlet valve 34 is opened; 2) the vent valve 36 is closed; 3) the outlet valve 38 is opened; and 4) the filler valve 66 is locked in place in the nozzle 18. These conditions allow fluid to flow through the nozzle 18 and into the vehicle fuel tank or other receptacle 26, as urged by the natural pressure of the fluid, by a pump or other means. Since the inlet valve 34 and outlet valve 38 are both biased to their closed positions, they help ensure that fluid does not flow through the nozzle 18 except under proper dispensing conditions, as outlined above.

In order to cease dispensing operations, the actuator 60 is released, and the actuator 60 naturally returns to its lower position, as biased by various springs and/or pressure of the dispensed fluid. As the actuator 60 moves to its lower position, the slider 92 moves in the axially downstream direction, moving the upstream shoulder 102 away from the inlet valve body 84, enabling the inlet valve 34 to move to its closed position, as biased by the inlet valve spring 90. As the slider 92 moves further in the downstream direction, the downstream shoulder 98 engages the vent valve body 70, pushing the vent valve 36 open and compressing the vent valve spring 76.

In addition, as the actuator 60 is lowered, the lever extension 62 slides upwardly and in the upstream direction, sliding along the sleeve ring 56, enabling the spring-biased sleeve 54 to be retracted/returned to its upstream position, thereby enabling the jaws 46 to spring outwardly to their radially outer positions, as shown in FIG. 4. The filler valve 66 can then be withdrawn from the nozzle 18, enabling the outlet valve 38 to return to its closed position, as biased by the outlet valve spring 46 and shown in FIG. 4.

The order of various actuating operations, as outlined above, can be varied as desired by adjusting the shape, size and spacing of various components. In the illustrated embodiment, however, raising the actuator 60 first causes the jaws 46 to secure the filler valve 66 in place; further raising of the actuator 60 next causes the vent valve 36 to close, and further operation of the actuator 60 next causes the inlet valve 34 to open. This order of operation ensures that the filler valve 66 is clamped in place, and the vent valve 36 will not allow fluid, which is intended to be dispensed, to escape via the vent valve 36. Finally, the inlet valve 34 is operated only once it is known that the nozzle 18 is secured in place and the vent valve 36 is closed.

The slider 92 can, in some cases, have an opening or radially-extending hole 112 formed therethrough (see FIGS. 5 and 9). When the actuator 60 is in the raised position and the slider 92 in its upstream position, as shown in FIG. 9, and pressurized fluid is introduced into the fluid path 30, a limited amount of such pressurized fluid may be permitted to escape the fluid path 30 via hole 112 and enter the chamber 114 positioned radially externally of the slider 92. The introduction of pressurized fluid in the chamber 114 can help to move the slider 92, and therefore vent valve body 70, in the downstream direction to open the vent valve 36 and improve the responsiveness of the vent valve 36 and/or inlet valve 34 during closing. The hole 112 arrangement can also help to return the actuator 60 to its lower position.

The actuator 60 can pivot across various ranges to be moved from its lower to its upper position, but in one case has a range of motion of between about 20° and about 35°. In addition, the actuator 60 (which controls motion of the slider 92) and the lever extension 62 (which controls movement of the sleeve 54 and closure of the jaws 46) both pivot about the actuator connection pivot point 64. This arrangement provides for simpler and easier operation, assembly and manufacture, as well as a robust construction as compared to certain other linkages, while still providing a sufficient mechanical advantage for ease of operation.

The operation of the vent valve 36 and the inlet valve 34 provides a bi-directional valve arrangement, in which the slider 92 positively engages and opens the inlet valve 34 when moved in the upstream direction, and positively engages and opens the vent valve 36 when moved in the downstream direction. Conversely, the slider 92 enables (or does not block) the spring biased vent valve 36 to open when the slider 92 moves in the upstream direction, and enables (or does not block) the spring biased inlet valve 34 to close when the slider 92 moves in the downstream direction. However, various other arrangements can be provided in which, for example, the vent valve 36 and/or inlet valve 34 are positively opened in one or both directions and/or allowed to open in either arrangement. The arrangement described above, however, ensures that both the vent valve 36 and the inlet valve 34 are positively opened.

In addition, the inlet valve 34 is closed when the inlet valve body 84 is moved to the left, in the downstream direction. This arrangement helps to ensure that any upstream pressure in the fluid path 30 pushes the inlet valve 34 further downstream into a tighter sealing arrangement. Similarly, the vent valve 36 is opened when the vent valve body 70 is moved in the downstream direction, and upstream fluid pressure thus helps to ensure proper venting is provided.

The actuator 60/lever extension 62/link 104 arrangement provides a two-bar linkage for moving the slider 92 which has a variable power/translation output. In particular, when the actuator 60 is in its lower position, as shown in FIG. 2, the link pivot point 106 is positioned below the actuator pivot point 64. In this manner, when the actuator 60 is initially raised, the link arrangement 104 provides relatively high translation of the slider 92 but relatively low power applied to the slider 92, due to the fact that the link pin point 106 follows a radial path about the actuator pin point 64. Thus, using vector analysis, it can be seen that the angular velocity of the link 104 at the link pivot point 106 will be high, and as the link pivot point 106 moves along the arc, during initial movement of the actuator 60.

When the actuator 60 nears its upper position, and is, in one embodiment, about 7° from the end of its upper motion, as shown in FIG. 7, the link 104 is in a horizontal or nearly horizontal position. The amount of horizontal translation that is available is thus minimized such that the angular velocity of the link 104 is low but power applied to the link 104 is highest. Thus, the link arrangement provides high power at the end of the actuator 60 stroke which helps to open the inlet valve 34 with the largest possible mechanical advantage. Thus, initial movement of the actuator 60 from the lower position to the upper position applies less power to the slider component 92 but higher translation; in contrast, later, final movement of the actuator 60 from its lower position to its upper position provides higher power and less translation.

Figure 10:
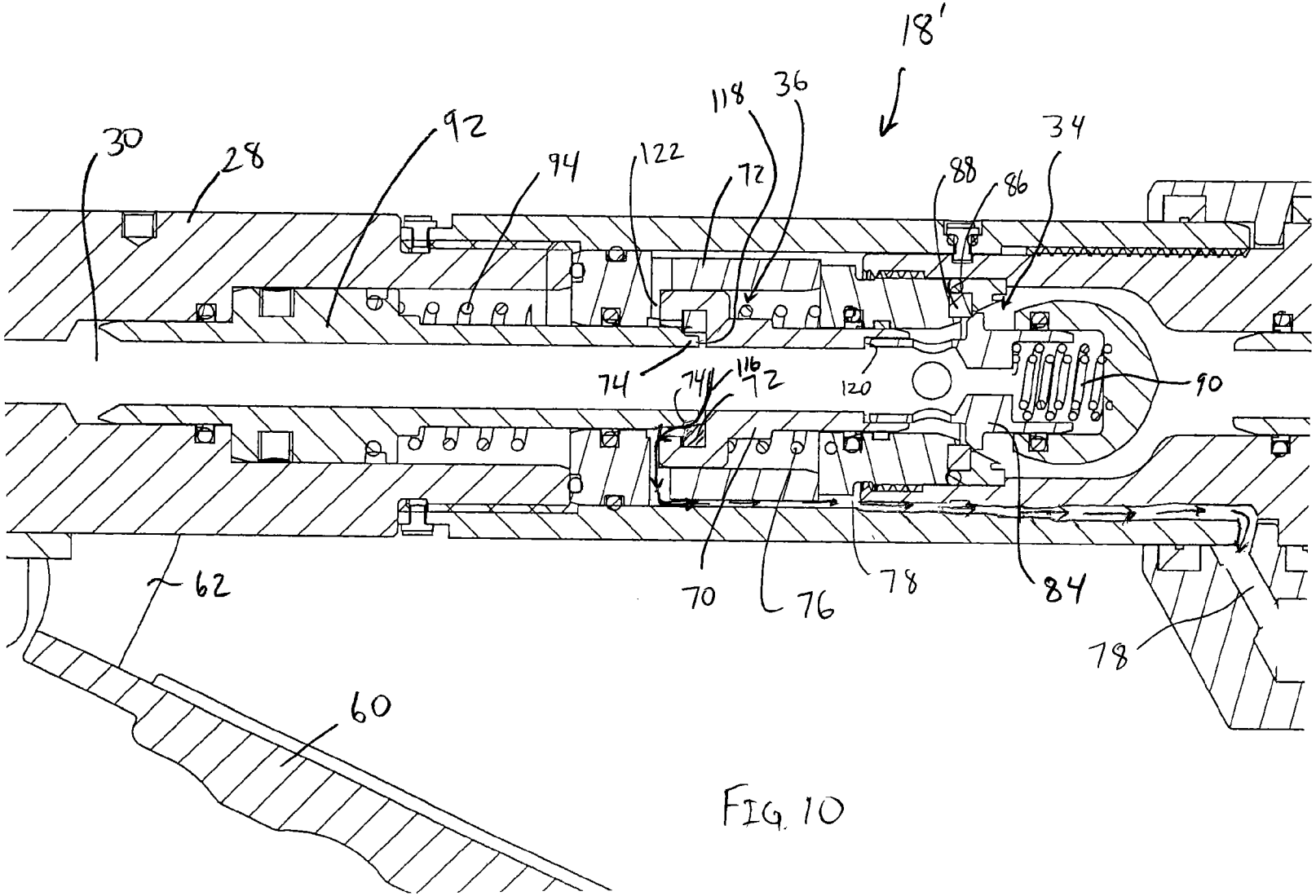
FIG. 10 is a detail side cross section of an alternative nozzle with the actuator in its lower position.
Figure 11:
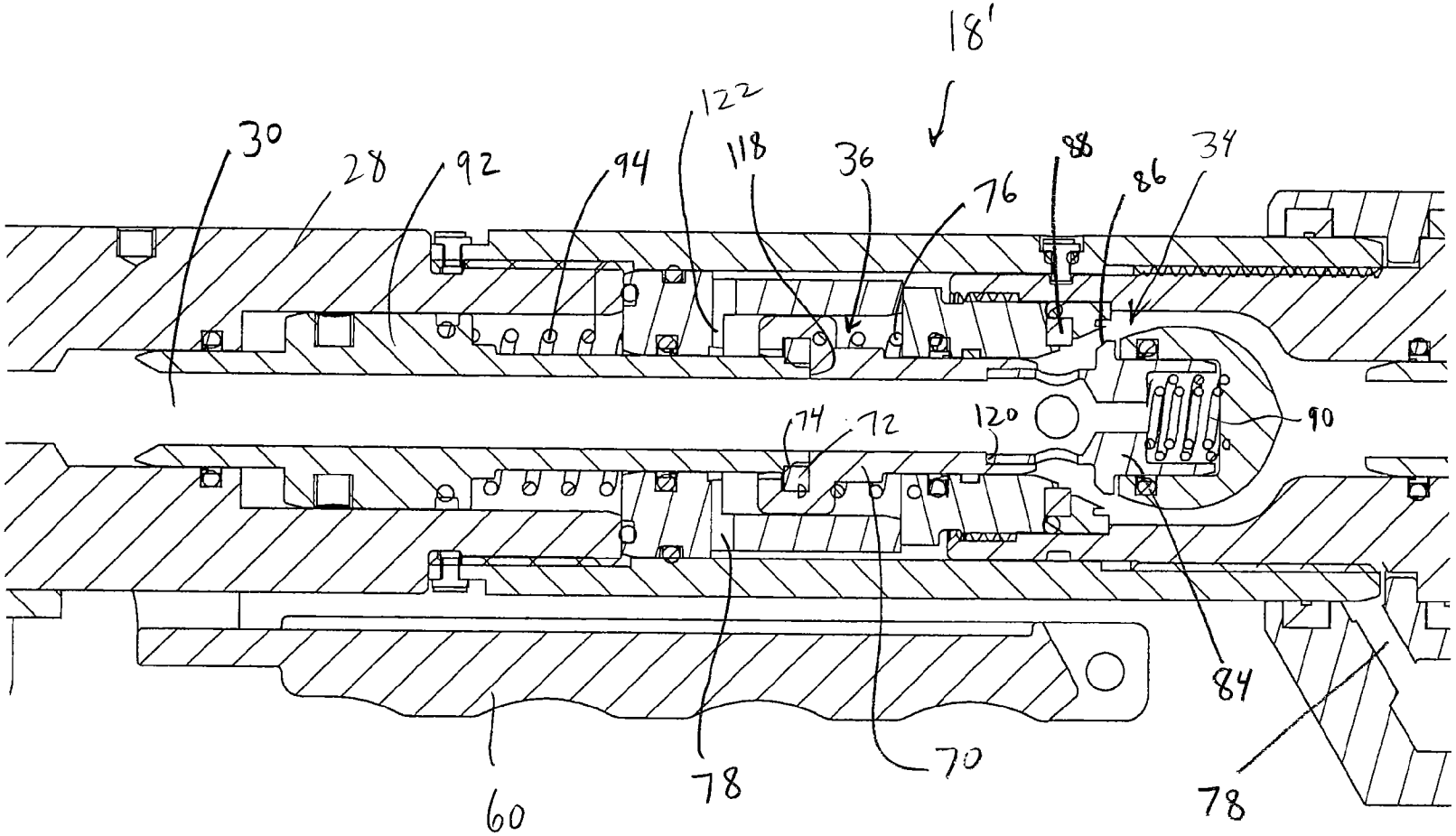
FIG. 11 is a side cross-section of the nozzle of FIG. 10, with the actuator in its upper position.

FIGS. 10 and 11 illustrate an alternative nozzle design 18'. In this particular case, the operation of the actuator 60, and opening/closing of the jaws 46, and various other features are the same as that in the embodiment described above. However, in the embodiments of FIGS. 10 and 11 the vent valve 36 is positioned between the slider 92 and the inlet valve 34, as opposed to the slider 92 being positioned between the vent valve 36 and the inlet valve 34. In this embodiment, the vent valve 36 is biased to its closed position by the vent valve spring 76 such that the vent valve body 70, carrying the vent valve seal 72 thereon, is biased to engage the vent valve seat 74, closing the vent path, as shown in FIG. 11. FIG. 10 illustrates the vent valve 36 in its open position, wherein the vent valve seal 72 is spaced away from the vent valve seat 74 to open the vent path 78. Arrow 116 illustrates the path of fluid from the fluid path 30 to the vent path 78 when the vent valve 36 is open, with certain portions of the vent path 78 around arrow 116 enlarged for illustrative purposes.

The inlet valve 34 is biased to its closed position by the inlet valve spring 90, which urges the inlet valve body 84 against the inlet valve seal 88 in a similar manner to that described above. The slider 92 is biased to its downstream position by the slider spring 94, and the vent valve body 70 is biased to its downstream position by the vent valve spring 76. The vent valve body 70 engages a stop surface 122, which prevents the vent valve spring 76 from pushing the vent valve body 70 further downstream from the position shown in FIG. 10.

When the actuator 60 is moved from its lower position (FIG. 10) to its upper position (FIG. 11), the slider 92 is directly moved in the upstream direction. The upstream shoulder/axial end or engagement surface 118 of the slider 92 engages the vent valve body 70, closing the vent valve 36. After, or as, the vent valve 36 is closed, the vent valve body 70 is moved upstream and an upstream shoulder/axial end or engagement surface 120 of the vent valve body 70 engages the inlet valve body 84 and moves the inlet valve body 84 upstream, opening the inlet valve 84. Fluid can then be dispensed in the manner outlined above. Thus, the slider 92 moves upstream towards both the vent valve 36 and the inlet valve 34 during activation/raising of the actuator 60. The vent valve 36 is thereby positively closed and the inlet valve 34 is positively opened when the actuator 60 is raised, providing a uni-directional valve system.

When the actuator 60 is released, and/or moved from its upper position to its lower position, the slider 92 moves downstream and the inlet valve 84 is closed, as biased by the inlet valve spring 90, and the vent valve 36 is opened, as biased by the vent valve spring 76. As the slider 92 continues to move downstream/to the left, the vent valve body 70 and the inlet valve body 84 each engage stop locations 122, 88, respectively on the nozzle body 28 to prevent further travel of the vent valve body 70 and inlet valve body 84, respectively. The slider 92 moves away, downstream, from the vent valve 36 and the inlet valve 34 when the actuator 60 moves to its lower position. Thus both the vent valve 36 and the inlet valve 34 are enabled/allowed to be closed (e.g. closed by their springs 76, 90 and not necessarily positively closed) when the actuator 60 moves from its upper position to its lower position.

Figure 12:
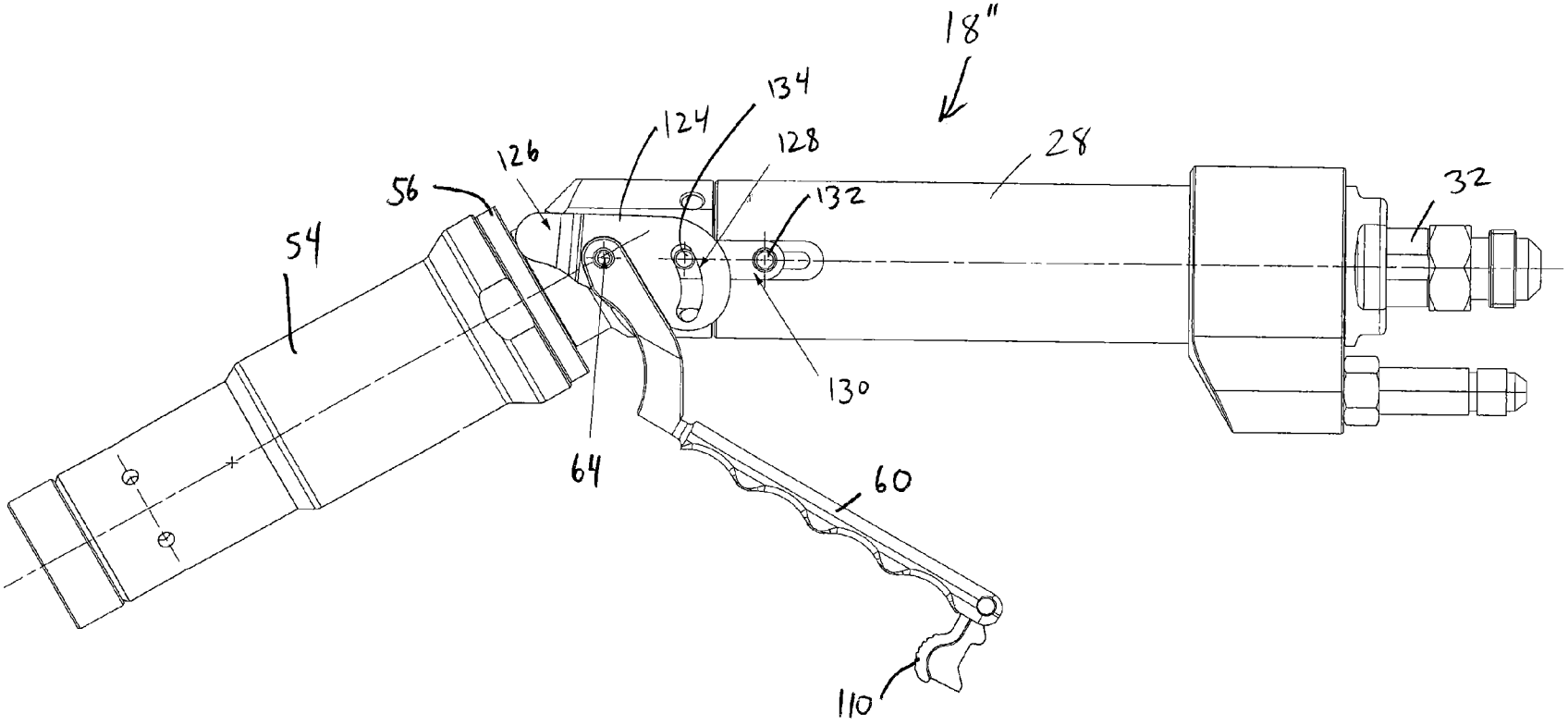
FIG. 12 is a side view of a further alternative nozzle.
Figure 13:
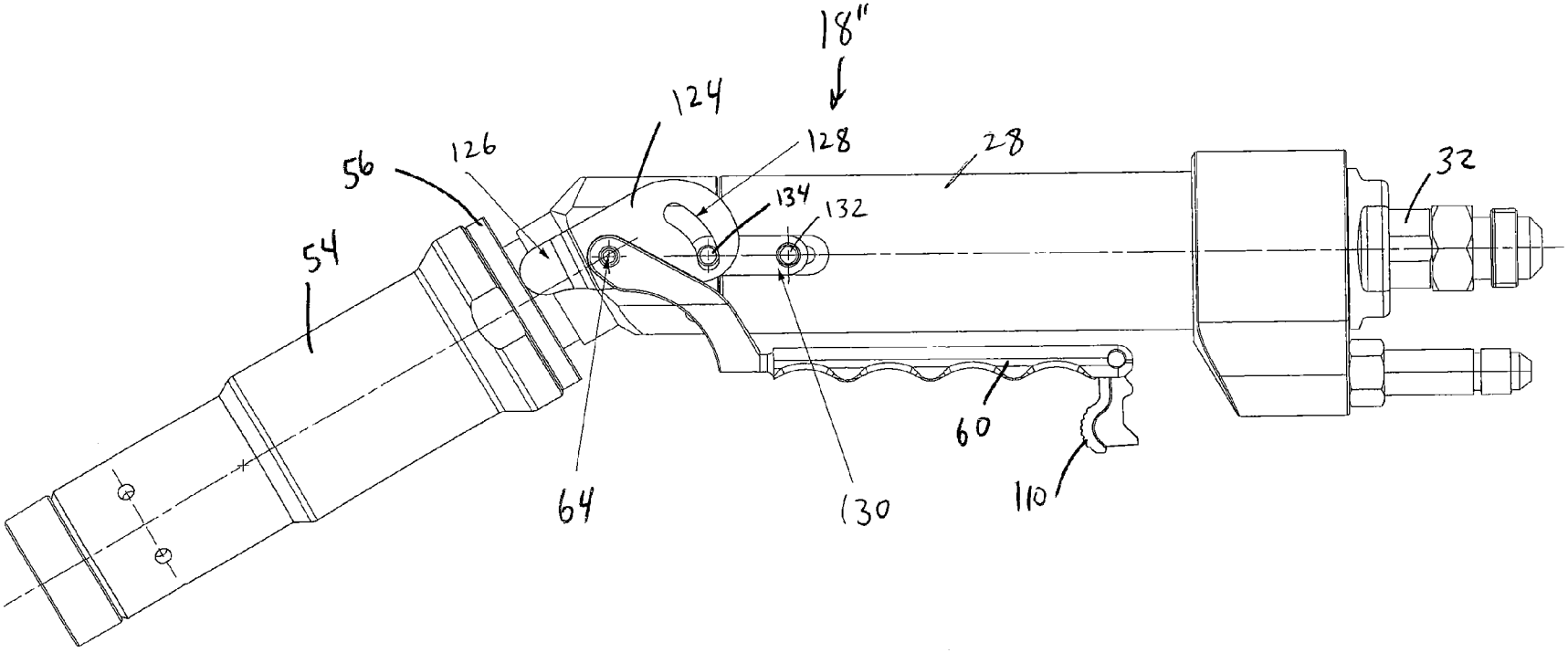
FIG. 13 is a side view of the nozzle of FIG. 12, with the actuator in its upper position.

FIGS. 12 and 13 illustrate a further alternative embodiment of the nozzle 18", which does not include the lever extension 62. Instead, the nozzle 18" includes a cam 124 directly pivotally mounted to the actuator 60 such that both the cam 124 and the actuator 60 pivot around the same pivot point 64. The cam 124 can include a nose 126 along its forward portion and slot 128 in its rearward portion. In the illustrated embodiment the slot 128 is curved and arcuate or generally arcuate. The nozzle 18" includes a connector 130 that is directly coupled, via a pin connection 132 in one case, to the slider 92 at an upstream end of the slider 92. The other end of the connector 130 includes a pin 134 that is slidably positioned in the slot 138. The connector 130 can be positioned in a groove or like such that the connector 130 can move only in the axial direction.

Accordingly, when the actuator 60 is raised from its lower position (FIG. 12) to its upper position (FIG. 13), the cam 124 pivots about the pivot point 64, causing the nose 126 of the cam 124 to engage the sleeve 54 and move the sleeve 54 in the downstream direction. This motion of the sleeve 54 causes the jaws 46 to move radially inward and lockingly engage the filler valve 66 in the same manner as in the embodiments of FIGS. 2-11. In addition, as the actuator 60 is raised and the cam 124 is pivoted, the connector 130 is moved in the upstream direction, as urged by the engagement between the pin 134 and the slot 128. In this manner pivoting of the actuator 60 results in the rotation of the cam 124 and, consequently, translational movement of the slider 92. The actuator 60/cam 124/connector 130 thereby pushes the slider 92 in the upstream direction and controls actuation of the vent valve 36 and/or inlet valve 34 in any of the various manners outlined above.

The nozzle and valve arrangements described herein thereby enable the nozzle to be operated in an intuitive manner by simply raising the actuator. The movement of the actuator can cause the nozzle to securely grip the filler valve, and various valves to open and/or close in the desired manner and desired order of operations, while maximizing the leverage/power of the user to provide ease of operations in one case.

Having described the invention in detail and by reference to the various embodiments, it should be understood that modifications and variations thereof are possible without departing from the scope of the invention.

What is claimed is:

1. A dispensing nozzle comprising:

a nozzle body defining a fluid path therein and configured such that fluid is flowable through said fluid path in a downstream direction;

an inlet valve in said fluid path;

a vent valve in said fluid path positioned downstream of said inlet valve;

a slide component positioned between said vent valve and said inlet valve; and an actuator that is manually movable between a first position and a second position, said actuator being operatively coupled to said slide component and configured such that operation of said actuator from said first position to said second position directly or indirectly causes said inlet valve to open and directly or indirectly causes said vent valve to close, wherein said actuator includes a pivotable lever positioned on a underside of said nozzle body to provide a pistol-style nozzle, wherein said actuator includes or is coupled to said slide component via a link, and wherein said link moves in an eccentric path when said lever is moved from one said first and said second position to the other one of said first and second positions.

2. The nozzle of claim 1 wherein said nozzle is configured such that movement of said actuator from said first position to said second position positively opens said inlet valve and does not positively close said vent valve but enables closing of said vent valve which is biased closed.

3. The nozzle of claim 1 wherein said nozzle is configured such that movement of said actuator from said second position to said first position positively opens said vent valve and does not positively close but enables closing of said inlet valve which is biased closed.

4. The nozzle of claim 1 wherein said slide component is in a first position and configured to block closing of said vent valve when said actuator is in said first position, and wherein said slide component is in a second position and not configured to block closing of said vent valve when said actuator is in said second position.

5. The nozzle of claim 1 wherein said first position of said actuator is a lower position and said second position is an upper position.

6. The nozzle of claim 1 wherein said actuator is coupled to said slide component via said link which is coupled to said actuator via a first pin connection and is coupled to said slide component via a second pin connection.

7. The nozzle of claim 6 wherein said actuator is pivotable relative to said nozzle body about an actuator pivot point, and wherein said link is pinned to said actuator at a link pivot point, wherein said link is pinned to said slide component at a pin connection point, and wherein said link pivot point is spaced away from said actuator pivot point.

8. The nozzle of claim 1 wherein said actuator is coupled to said slide component via a cam having a slot therein, said slot receiving therein a pin which is coupled to said slide component.

9. The nozzle of claim 1 wherein said slide component is positioned in said fluid path and configured such that moving said actuator from said first position to said second position causes said slide component to move axially in said fluid body.

10. The nozzle of claim 1 further comprising an outlet valve in said fluid path and positioned downstream of said inlet valve and said vent valve.

11. The nozzle of claim 1 wherein said inlet valve is movable between a closed position in which said inlet valve blocks fluid flow through said fluid path and an open position in which said inlet valve does not block fluid flow through said fluid path, and wherein said vent valve is movable between an open position in which said vent valve provide fluid communication between said fluid path and an ambient environment or a vent path positioned externally of said nozzle body, and a closed position in which said vent valve blocks fluid communication between said fluid path and the ambient environment or said vent path.

12. The nozzle of claim 1 wherein said slide component includes an opening formed therethrough to allow at least some of said fluid in said fluid path to escape said fluid path and enter a chamber, wherein said chamber is configured such that said pressurized fluid entering said chamber urges said vent valve to open.

13. The nozzle of claim 1 wherein said actuator is configured such that initial movement of said actuator from said first position to said second position applies less power to said slide component as compared to later movement of said actuator from said first position to said second position.

14. The nozzle of claim 1 further comprising a set of jaws positioned at a distal end of said nozzle body, said jaws being biased to a radially outer position, the nozzle further including a sleeve that is axially movable relative to said jaws to move said jaws to a radially inner position, and wherein said sleeve is operatively coupled to said actuator.

15. The nozzle of claim 14 wherein said actuator includes a lever extension that is at least partially axially moveable upon movement of said actuator from said first position to said second position, wherein said lever extension is configured to engage said sleeve to axially move said sleeve.

16. The nozzle of claim 15 wherein said sleeve includes a sleeve ring, and wherein said lever extension is configured to engage said sleeve ring and slide across a surface of said sleeve ring upon movement of said actuator from said first position to said second position.

17. The nozzle of claim 1 wherein said link both translates and rotates about a point passing therethrough when said lever is pivoted.

18. A dispensing nozzle comprising:

a nozzle body defining a fluid path therein and configured such that fluid is flowable through said fluid path in a downstream direction;

an inlet valve in said fluid path;

a vent valve in said fluid path positioned downstream of said inlet valve;

a slide component positioned in said fluid path;

a set of jaws positioned at a distal end of said nozzle body;

a sleeve that is axially movable relative to said jaws to adjust a radial position of said jaws; and an actuator that is directly manually movable between a first position and a second position, said actuator being operatively coupled to said slide component and configured such that operation of said actuator from said first position to said second position directly or indirectly causes said inlet valve to open and directly or indirectly causes said vent valve to close, wherein said actuator is a pivotable lever positioned on a underside of said nozzle body to provide a pistol-style nozzle, and wherein said actuator is configured to directly engage and axially move said sleeve.

19. The nozzle of claim 18 wherein said actuator is coupled to said slide component via a link, which is coupled to said both said actuator and said slide component via pin connections, and wherein said actuator is pivotable relative to said nozzle body about an actuator pivot point, and wherein said link is pinned to said actuator at a link pivot point, wherein said link is pinned to said slide component at a pin connection point, and wherein said link pivot point is spaced away from said actuator pivot point.

20. The nozzle of claim 18 wherein said slide component is positioned between said vent valve and said inlet valve, and wherein said nozzle is configured such that movement of said actuator from said first position to said second position positively opens said inlet valve and enables closing of said vent valve.

21. The nozzle of claim 18 wherein said vent valve is positioned between said slide component and said inlet valve, and wherein said nozzle is configured such that movement of said actuator from said first position to said second position positively closes said vent valve and positively opens said inlet valve.

22. A dispensing nozzle comprising:

a nozzle body defining a fluid path therein and configured such that fluid is flowable through said fluid path in a downstream direction;

an inlet valve in said fluid path;

a vent valve in said fluid path positioned downstream of said inlet valve;

a slide component positioned in said fluid path; and an actuator that is manually movable between a first position and a second position, said actuator being operatively coupled to said slide component and configured such that operation of said actuator from said first position to said second position directly or indirectly causes said inlet valve to open and directly or indirectly causes said vent valve to close, wherein said actuator is a pivotable lever positioned on a underside of said nozzle body to provide a pistol-style nozzle, wherein said actuator is configured such that initial movement of said actuator from said first position to said second position applies less power to said slide component as compared to later movement of said actuator from said first position to said second position.

23. The nozzle of claim 22 wherein said slide component is positioned between said vent valve and said inlet valve.

24. The nozzle of claim 22 wherein said actuator is coupled to said slide component via a link, which is coupled to said both said actuator and said slide component via pin connections.

25. The nozzle of claim 22 wherein said nozzle is configured such that movement of said actuator from said first position to said second position positively opens said inlet valve and does not positively close said vent valve but enables closing of said vent valve which is biased closed.

26. A dispensing nozzle comprising:

a nozzle body defining a fluid path therein and configured such that fluid is flowable through said fluid path in a downstream direction;

an inlet valve in said fluid path, said inlet valve including a movable inlet valve body;

a vent valve in said fluid path positioned downstream of said inlet valve, said vent valve including a movable vent valve body;

a slide component positioned in said fluid path; and an actuator that is manually movable between a first position and a second position, said actuator being operatively coupled to said slide component and configured such that operation of said actuator from said first position to said second position positively opens said inlet valve and movement of said actuator from said second position to said first position positively opens said vent valve.

27. The nozzle of claim 26 wherein said nozzle is configured such that movement of said actuator from said first position to said second position does not positively close said vent valve but enables closing of said vent valve which is biased closed, and wherein said nozzle is configured such that movement of said actuator from said second position to said first position does not positively close said inlet valve but enables closing of said inlet valve which is biased closed.

28. The nozzle of claim 26 wherein said slide component is positioned between said vent valve and said inlet valve.

29. The nozzle of claim 26 wherein said actuator is a pivotable lever positioned on a underside of said nozzle body to provide a pistol-style nozzle, and wherein said actuator is coupled to said slide component via a link, which is coupled to said both said actuator and said slide component via pin connections.

30. The nozzle of claim 26 wherein said inlet valve includes an inlet valve seat, and wherein said inlet valve body is movable between a closed position wherein said inlet valve body sealingly engages said inlet valve body and an open position wherein said inlet valve body does not sealingly engage said inlet valve body, and wherein said vent valve includes a vent valve seat, and wherein said vent valve body is movable between a closed position wherein said vent valve body sealingly engages said vent valve body and an open position wherein said vent valve body does not sealingly engage said vent valve body.

31. The nozzle of claim 30 wherein said slide component does not sealingly engage said inlet valve seat or said vent valve seat.

32. The nozzle of claim 26 wherein said slide component is at least partially independently movable relative to said inlet valve body and said vent valve body.

* * * * *